US007549434B2

(12) United States Patent
Bean

(10) Patent No.: US 7,549,434 B2
(45) Date of Patent: Jun. 23, 2009

(54) PORTABLE HUNTING BLIND

(75) Inventor: Ron M. Bean, Cedar Rapids, IA (US)

(73) Assignee: Hunter's Specialties, Inc., Cedar Rapids, IA (US)

( * ) Notice: Subject to any disclaimer, the term of this patent is extended or adjusted under 35 U.S.C. 154(b) by 401 days.

(21) Appl. No.: 11/387,270

(22) Filed: Mar. 23, 2006

(65) Prior Publication Data

US 2007/0221261 A1 Sep. 27, 2007

(51) Int. Cl.
*E04H 15/48* (2006.01)

(52) U.S. Cl. ..... 135/143; 135/901

(58) Field of Classification Search ..... 135/116, 135/122, 128, 143, 900, 901
See application file for complete search history.

(56) References Cited

U.S. PATENT DOCUMENTS 4,599,832 A * 7/1986 Benton et al. ..... 52/118
4,751,936 A * 6/1988 Zibble et al. ..... 135/117
5,133,378 A * 7/1992 Tanasychuk ..... 135/148
5,762,085 A * 6/1998 Punch ..... 135/93
D405,890 S 2/1999 Latschaw
6,016,823 A * 1/2000 Hill ..... 135/124
6,698,131 B2 3/2004 Latschaw

OTHER PUBLICATIONS

Advertisements for portable hunting blinds.

* cited by examiner

*Primary Examiner*—David Dunn
*Assistant Examiner*—Danielle Jackson
(74) *Attorney, Agent, or Firm*—McKee, Voorhees & Sease, P.L.C.

(57) ABSTRACT

The present invention is a portable hunting blind having a base frame, an upper frame pivotally connected to the base frame, a breakaway support operatively connected between the base frame and the upper frame for supporting the upper frame in a first position and allowing the upper frame to pivot to a second position when the breakaway support no longer supports the upper frame. A cover is attached to the blind to at least partially conceal a person in the blind when the upper frame is supported by the breakaway support.

16 Claims, 7 Drawing Sheets

PORTABLE HUNTING BLIND

BACKGROUND OF THE INVENTION

This invention relates to a portable hunting blind and method of using the same.

Hunters and wildlife enthusiasts have known for many years that concealing themselves from wildlife allows them an opportunity to have the wildlife come much closer to them without being spooked away. Thus, the use of blinds for hunters, wildlife photographers, and outdoor enthusiasts is well-known in the art. Many types of blinds have been used over the years. For example, permanent blinds can be set up in a location known to have the desired wildlife and used for concealing oneself inside. Similarly, portable blinds have been used over the years to temporarily set up on a location where the desired wildlife is likely to be. One problem with these temporary blinds is that they can be quite large and heavy. Another problem with temporary blinds is that they tend to be cumbersome and difficult to set up in the field. Another problem is that many of them are difficult to see, shoot or photograph out of. Thus, it is desirable to have an improved portable hunting blind which addresses these problems.

In view of the foregoing problems, the primary feature or advantage of the present invention is to provide an improved portable hunting blind.

Another feature or advantage of the present invention is a hunting blind which can be easily transported to the desired location.

Another feature or advantage of the present invention is a hunting blind which is easily operable by one person.

Another feature or advantage of the present invention is a hunting blind which can be easily covered with different types of camouflage covering allowing the blind to blend into the surroundings where it is used.

Another feature or advantage of the present invention is a hunting blind which allows quick and easy access to the user to exit the blind and gain access to wildlife.

A further feature or advantage of the present invention is a provision of a portable hunting blind which is economical to manufacture, durable in use, and efficient in operation.

A still further feature or advantage of the present invention is a method of operating a hunting blind which is quick and simple to use.

These and/or other features or advantages of the present invention will be apparent from the specification and claims that follow.

BRIEF SUMMARY OF THE INVENTION

One or more of the foregoing features or advantages may be achieved by a portable hunting blind having a base frame, an upper frame pivotably connected to the base frame, a breakaway support operatively connected between the base frame and the upper frame for supporting the upper frame in a first position and allowing the upper frame to pivot to a second position when the breakaway support no longer supports the upper frame, and a cover attached to the blind to at least partially conceal a person in the blind when the upper frame is supported by the breakaway support.

Another aspect of the present invention is a hunting blind using a biasing device, such as an elastic cord, attached to a breakaway support for holding the breakaway support in a supporting position while supporting a portion of the blind in place and allowing a rip cord, which is attached to the breakaway supports, to be pulled to breakaway the supports so they no longer support a portion of the blind.

Another aspect of the present invention is a blind having one or more doors pivotably connected to the frame for at least partially concealing the person inside the blind when the one or more doors are in a closed position. In addition, there may be a roller door stop for stopping the doors from pivoting too far in one direction.

Another aspect of the present invention is a blind which is supported by breakaway supports having a double breakaway hinge which allow the breakaway supports to no longer support an upper portion of the frame of the blind when broken down.

Another aspect of the present invention is a blind which is covered with a camouflaged covering to further conceal one inside the blind.

A further aspect of the present invention is a blind constructed of tubular material in which the frame folds together.

One or more of the foregoing features or advantages may also be achieved by a portable hunting blind having a base frame, an upper frame hingedly connected to the base frame, a breakaway support hingedly connected between the base frame and the upper frame, a biasing device connected to the breakaway support for holding the breakaway support in the first position to support the upper frame above the base frame in allowing the upper frame to hinge towards the base frame when the breakaway support is moved to a second position, and a cover attached to the frames for at least partially concealing an inside area of the blind.

Another aspect of the present invention is a blind having an opening in the cover to allow viewing from inside the blind to outside the blind.

Another aspect of the present invention is a blind having a covering which is thermal to maintain heat on an inside area of the blind.

One or more of the foregoing features or advantages may additionally be achieved by a method of operating a hunting blind by providing a hunting blind, concealing a hunter at least partially within the hunting blind, and allowing the hunter to pull a rip cord attached to a breakaway support that supports a portion of the blind, so that the portion of the blind supported by the breakaway falls, and thus collapses the blind.

The foregoing features or advantages may furthermore be achieved by a method of setting up a hunting blind by providing the blind, placing the blind on a surface and setting a breakaway support, that is operatively connected between a base frame and an upper frame, to support the upper frame in a first position and allowing the upper frame to pivot to a second position when the breakaway support no longer supports the upper frame.

DETAILED DESCRIPTION OF THE PREFERRED EMBODIMENT

The present invention is a portable hunting blind assembly 10 which allows an occupant to conceal themselves within the blind 10, yet quickly and easily expose themselves or gain access to the outside of the blind 10 for hunting purposes. FIGS. 1-6 show the preferred embodiment of the present invention.

Figure 1:
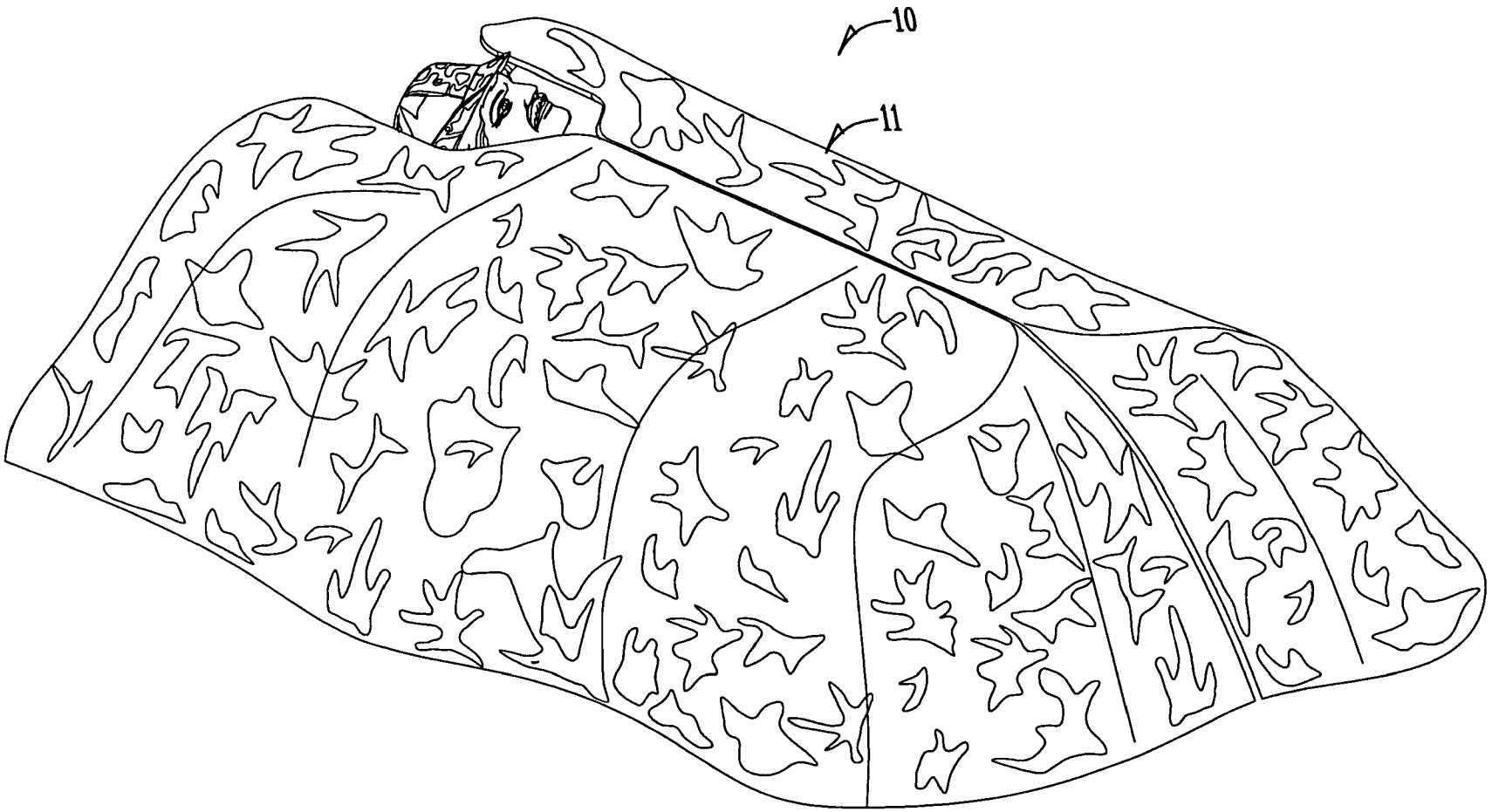
FIG. 1 shows one embodiment of a portable hunting blind in the present invention with a camouflage cover.
Figure 2:
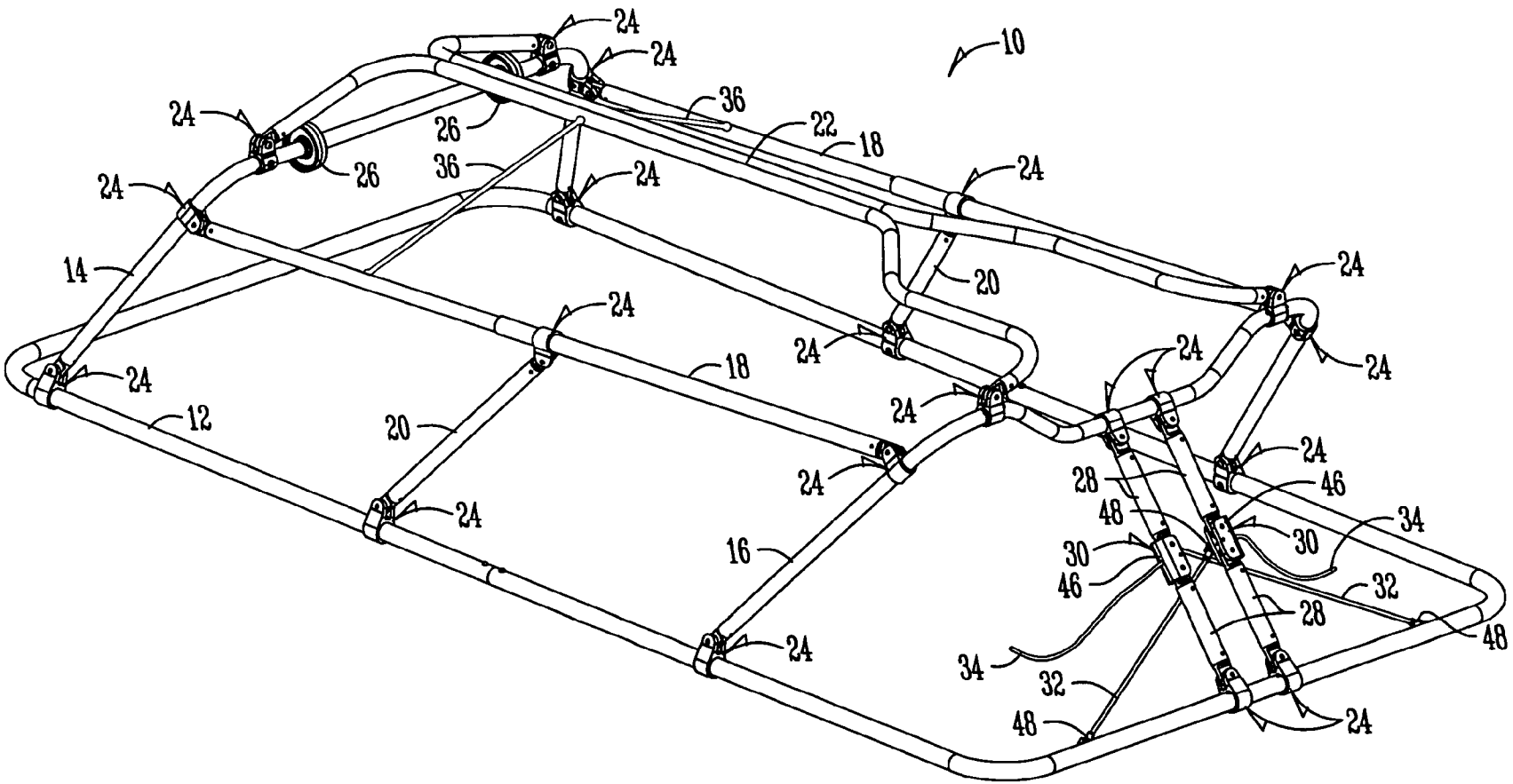
FIG. 2 shows one view of the blind frame assembly for the blind shown in FIG. 1 without a cover attached.
Figure 3:
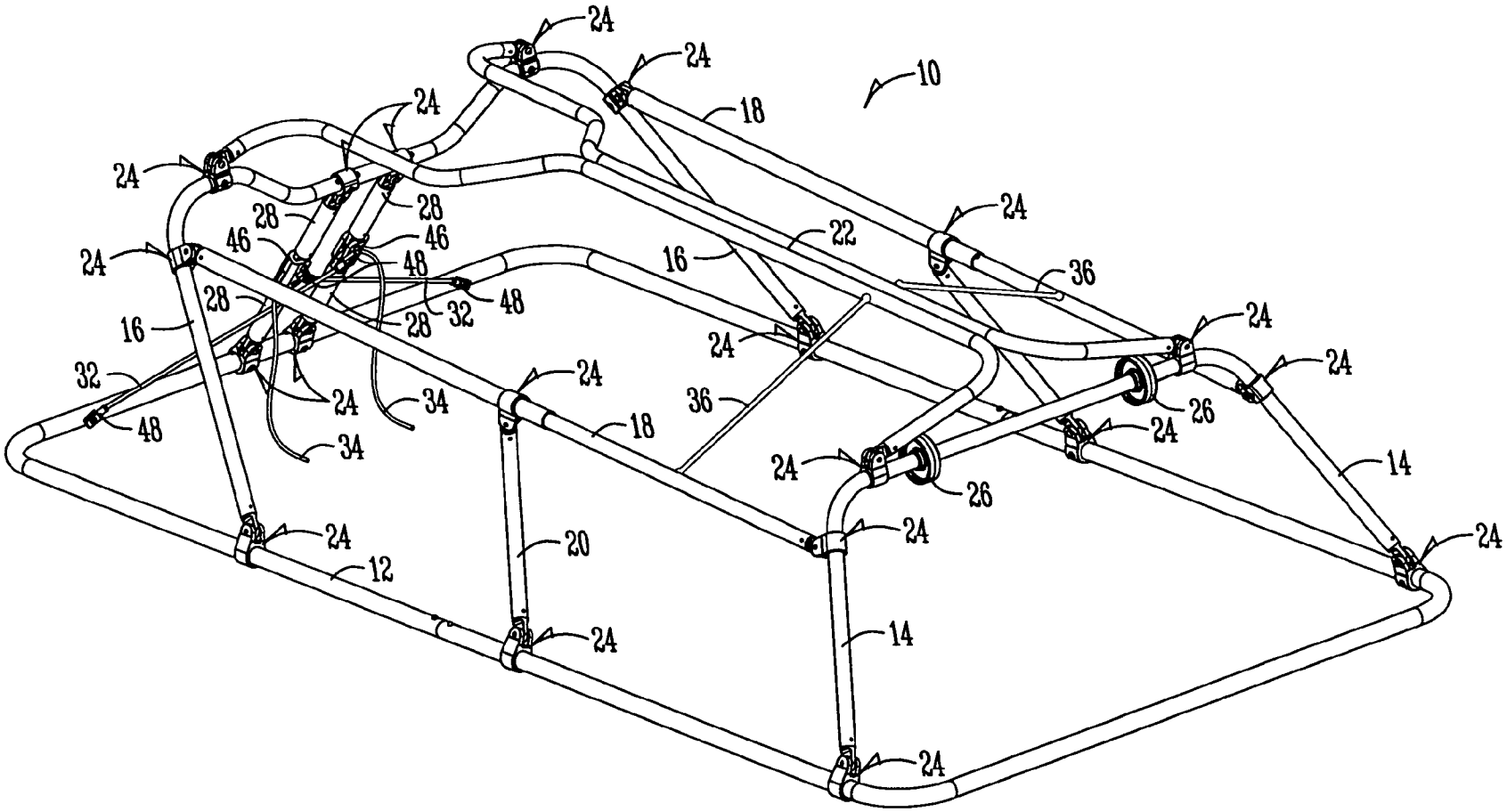
FIG. 3 shows another view of the blind frame assembly of FIG. 2.
Figure 4:
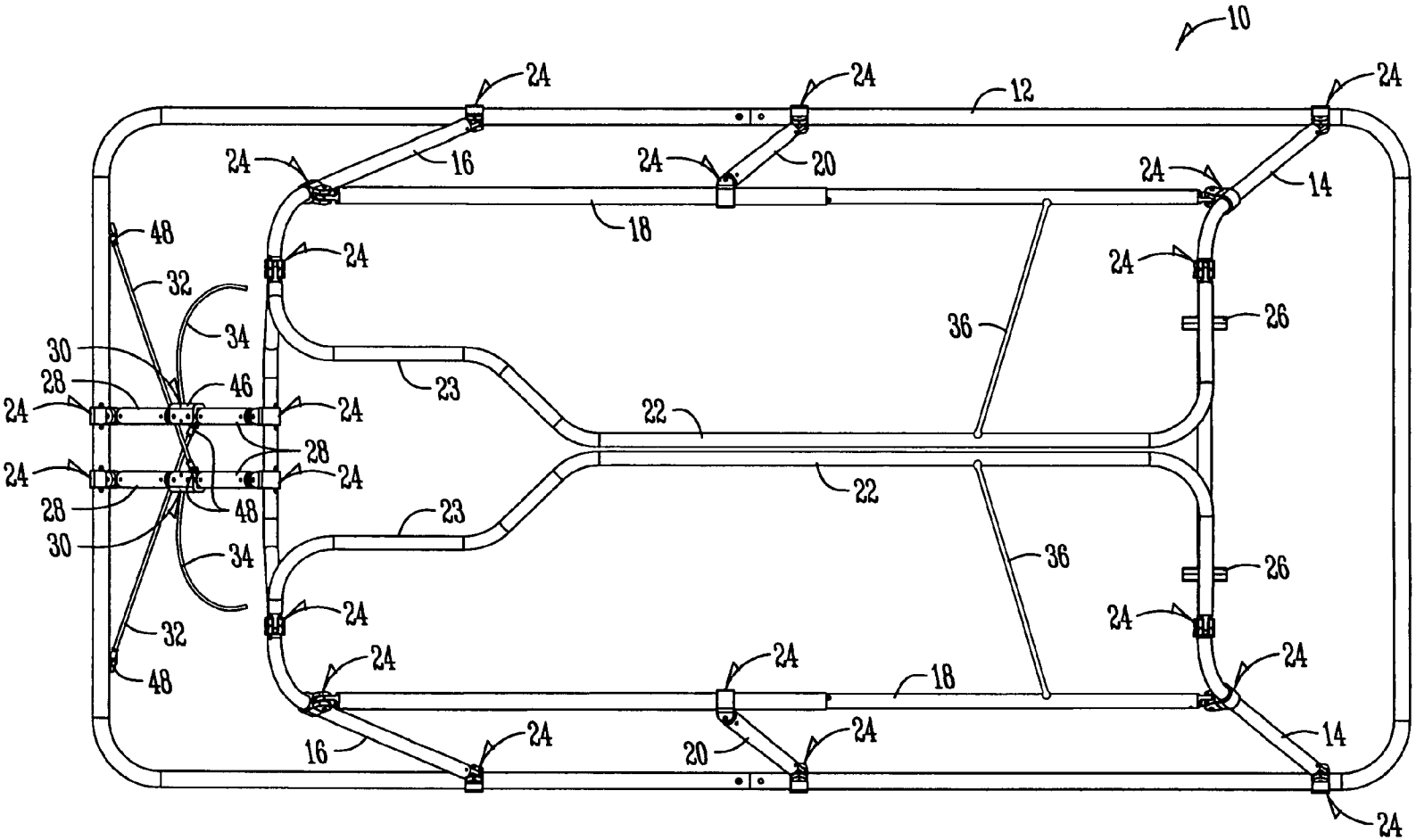
FIG. 4 shows a top view of the blind frame assembly shown in FIG. 2.

FIG. 1 shows the blind assembly 10 with the cover 11 extended around the outside of the blind assembly 10. Preferably, the cover 11 is camouflaged or otherwise designed to resemble the surrounding area to conceal the blind 10.

In FIGS. 2-6, the blind assembly 10 can be seen without the cover 11 so that the structure of the blind assembly 10 is visible. The present invention generally comprises a base frame 12, a foot frame 14, a head frame 16, and a side rail 18. In addition, one or more side supports 20 may be used to support the side rail 18 with the base frame 12 so that when a person exiting the blind assembly 10 gets up to exit the blind they can push downward on the side rails 18 without damaging the side rails 18. The blind assembly 10 is preferably made from tubular metal, however any suitable material can be used which gives the proper support and strength required for the blind assembly 10.

Figure 12:
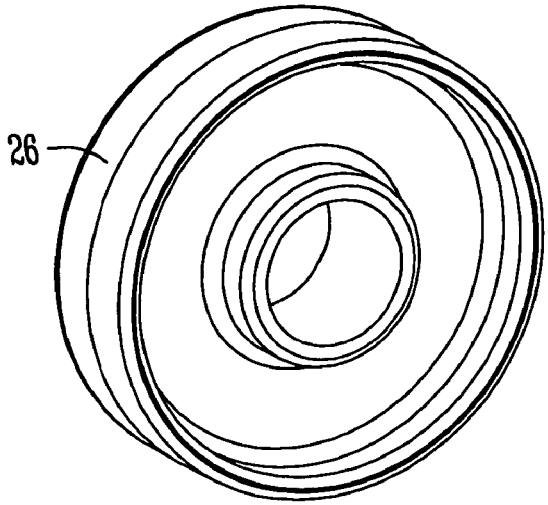
FIG. 12 shows one embodiment of a roller door stop for use with the present invention.

As shown in FIGS. 2-6, the blind assembly 10 preferably has one or more top door rails 22 hingedly connected to the foot frame 14 and the head frame 16. The top of door rail 22 can be swung open or closed using the hinge assemblies 24 so that the person inside the blind assembly 10 can enter or exit the blind assembly 10. As shown, the user of the blind assembly 10 preferably lays on their back inside the blind assembly 10 and can see out of the blind assembly 10 with an opening 23 formed in the top door rails 22. Thus, the user can see approaching wildlife, such as ducks or geese. Attached to the foot frame 14 are roller door stops 26 which prevent the door rail 22 from closing too far inward on the blind assembly 10. The roller door stop 26 can be seen in FIG. 12. A user of the blind 10 may prop the door rails 22 further open or closed by sliding the door stops 26 further inward or outward on the foot frame 14. Thus, the door stops 26 preferably have a snug, but moveable, fit with the foot frame 14. As the door stops 26 are positioned closer together, the door rails 22 close more. As the door stops 26 are positioned further apart, the door rails 22 contact the door stops 26 and cannot close as far.

Figure 5:
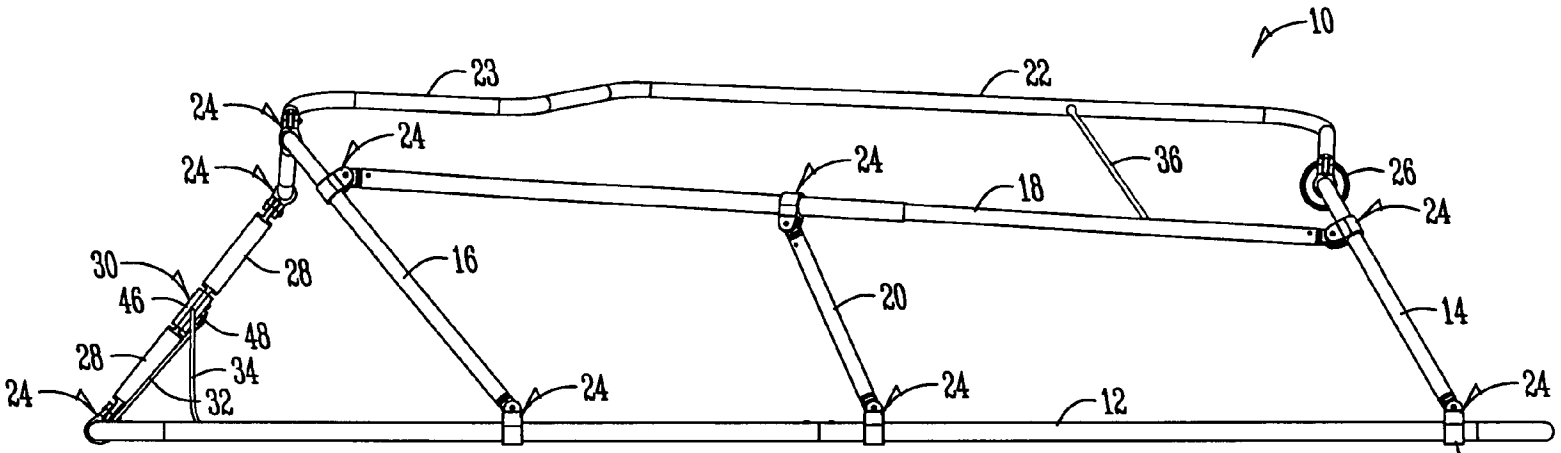
FIG. 5 shows a side view of the frame assembly shown in FIG. 4 with part of the support frame moving.
Figure 6:
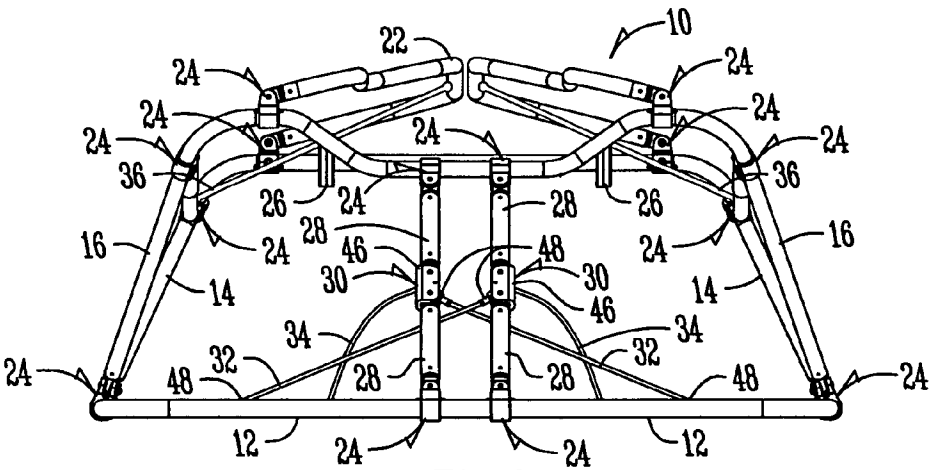
FIG. 6 shows another side view of the frame assembly shown in FIG. 4 with part of the frame assembly moving.

The blind assembly 10 is held together and hingedly connected between the base frame 12, the foot frame 14, the head frame 16, the side rails 18, and the side supports 20 with hinge assemblies 24. This allows the upper portion of the blind assembly 10, i.e., foot frame 14, head frame 16, side rail 18, side support 20, and top door rail 22, to fall or hinge downward towards the base frame 12. This hinging action provides multiple functions. First of all, this hinge action, as shown in FIGS. 5 and 6, allows for the blind assembly 10 to fold up for easy transporting of the blind assembly 10. Additionally, this hinge action allows for the upper portion of the blind assembly 10 to fall downward towards the base frame 12 when the breakaway support rails 28 have been broken down or pulled outward so that the breakaway support rails 28 no longer support the upper portion of the blind assembly 10.

Referring to FIGS. 2-6, the breakaway support rails 28 are connected between the head frame 16 and the base frame 12. A double hinge or breakaway hinge assembly 30 is located between two sections of the breakaway support rail 28. Additionally, hinge assemblies 24 are located on each end of the breakaway support rail 28. Preferably, a biasing device 32, such as elastic cord, bungee cord, spring, or the like, is connected between a base frame 12 and the breakaway hinge assembly 30 pulling the breakaway support rail 28 into an extended or somewhat upright position supporting the head frame 16, which in turn supports the rest of the upper frame. This creates an open space inside the blind assembly 10 for a person to conceal themselves within.

To use the blind 10, a user conceals themselves inside by entering one or more doors created by the door rail 22, resting on the user's backside and closing the doors 22. To expose the user, the user simply opens the door frame 22. The door rail 22 has a stretchable cord 36 attached so that when the door rail 22 is closed tension is on the cord 36. However, once the door rail 22 closes past a center point, the tension helps to hold the door rail 22 closed. Then, once the door rail 22 is opened to just past center, the door rail 22 is pulled open by the cord 36. Once the user of the blind assembly 10 is exposed, he or she may then easily get up from the laying down position to shoot or may shoot from a reclining position. To break down the blind, the person using the blind assembly 10 pulls on one or more rip cords 34 which are attached to an outside portion of the breakaway hinge assembly 30 causing the breakaway hinge assembly 30 to break down or fold outward so that support is no longer given to the head frame 16. When this happens, the head frame 16 falls downward towards the base frame 12 and pulls the foot frame 14, side rails 18, side supports 20, and top door rails 22 along with it and thus collapses the blind assembly 10. In at least one embodiment, a user may break down the blind 10 while inside the blind 10, having the blind 10 collaps around the user and having the door rails 22 open and thus quickly exposing the user for hunting. By breaking down the blind 10 to expose the user, the user can avoid interference from the blind 10 when hunting.

Figure 7:
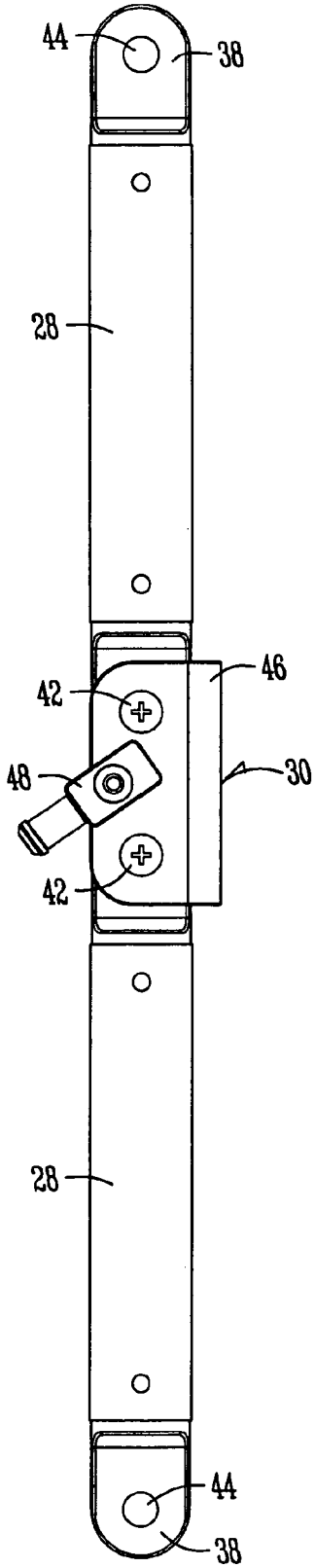
FIG. 7 shows one embodiment of a breakaway support for use with the present invention.

FIG. 7 shows a preferred embodiment of the breakaway hinge assembly 30 and the breakaway support rails 28. Having the breakaway support rail assemblies constructed in this manner allows them to hinge at both ends and along the support rail 28 causing the support rail 28 to break down and fold.

Figure 8:
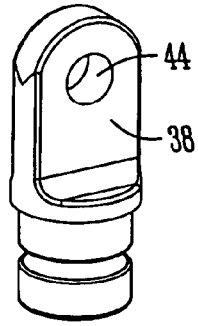
FIG. 8 shows one embodiment of a hinged blade for use with the present invention.
Figure 9:
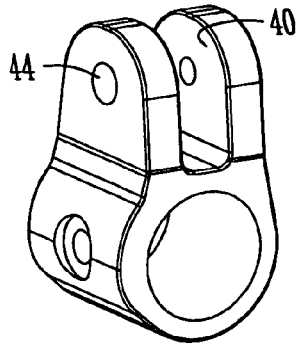
FIG. 9 shows one embodiment of a hinged socket used with the present invention.

FIG. 8 shows a preferred embodiment of the hinge blade 38 for use with the hinge assemblies 24. The hinge blade 38 mates with a hinge socket 40, shown in FIG. 9. Both the hinge blade 38 and the hinge socket 40 have a hinge pivot hole 44 which aligned between the hinge blade 38 and the hinge socket 40 and have a hinge pin/screw 42 to hold the parts 38, 40 together and allow a hinging movement between the two parts 38, 40. Preferably, the hinge blade 38 has a portion which mates with an inside of a tubing and preferably a hinge socket 40 has a portion which mates with an outside of a tubing, thus, allowing the hinge assembly 24 to hold the blind assembly 10 together and still allow hinged motion.

Figure 10:
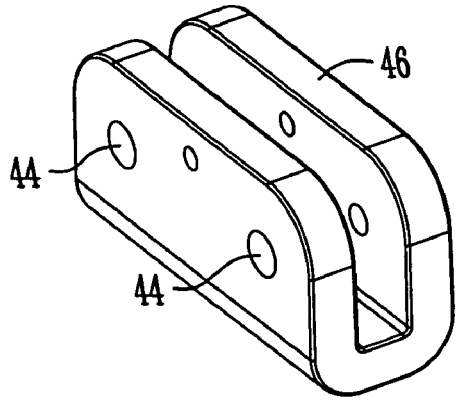
FIG. 10 shows one embodiment of a breakaway hinge bracket for use with the present invention.

FIG. 10 shows a preferred embodiment of the breakaway hinge bracket 46. The breakaway hinge bracket 46 mates with two of the hinge blades 38 using two hinge pin/screws 42 through hinge pin pivot holes 44 thereby creating a double hinge. This allows the breakaway support rail 28 to fold or break down when required.

Figure 11:
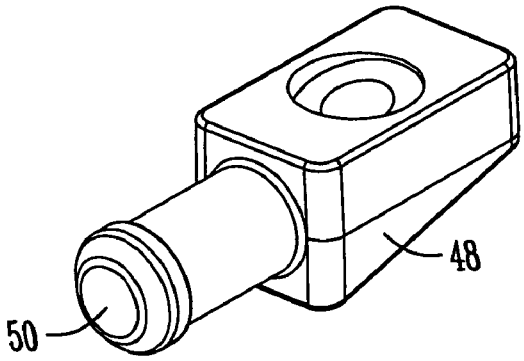
FIG. 11 shows one embodiment of a biasing device connector for use with the present invention.

Attached to the base frame 12 and the breakaway hinge bracket 46 are biasing device connectors 48. These can best be seen in FIG. 11. The biasing device connector 48 connects the biasing device 32 between the base frame 12 and the breakaway hinge assembly 30. Therefore, the biasing device 32, as shown in FIGS. 2-6, hold the breakaway support rails 28 in an extended position to support the head frame 16. The biasing device 32 can enter through the biasing device connector socket 50 and can be held in place by an adhesive, glue, or by simply crimping the outer portion of the biasing device connector socket 50 as is commonly known in the art.

As shown in the accompanying figures and described, the blind assembly 10 of the present invention is a simple, portable hunting blind which can be easily moved from place to place and easily operated to conceal a hunter, yet allow them quick access to exit the hunting blind assembly 10 by simply opening the door frames 22. Breakdown of the blind is accomplished by pulling the rip cords 34 to break down the breakaway support rails 28 and allow the upper frame assembly to fall downward. The cover 11, as mentioned above, is preferably made with a camouflage design to help conceal the blind assembly 10. In addition, the cover 11 can be made from a thermal-type material to help retain heat inside the blind assembly 10. In addition, the cover 11 helps to block wind from the user of the blind assembly 10.

The blind assembly 10, as shown, allows a single user to lie in a somewhat reclined position, either on the ground, or on a supporting device, such as a sling, net, cot or the like, (not shown), and view outward through the viewing window 23 formed into the top door rail 22. However, the present invention can be made any size and can accommodate any number of people.

The term breakaway support or breakaway hinge assembly is used throughout this application. This does not mean that the breakaway support or the breakaway hinge physically break away from the device. The term breakaway in this application simply means that the breakaway supports or breakaway hinges fold, breakdown, or otherwise move to no longer support the structure that they were previously supporting and thus allow the previously supported portion to fall with the appearance that the supports have broken away. Any type of supports can be used in the present invention which operates in a similar manner. In other words, the breakaway supports and breakaway hinge do not have to fold as shown in the present invention.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A portable hunting blind comprising:

a base frame;

an upper frame pivotally connected to the base frame;

a first breakaway support operatively connected between the base frame and the upper frame for supporting the upper frame in an erected position and allowing the upper frame to pivot to a collapsed position when the breakaway support no longer supports the upper frame;

a first biasing device attached to the first breakaway support for holding the breakaway support in a supporting position while supporting the upper frame in the erected position; and a cover attached to the blind to at least partially conceal a person in the blind when the upper frame is supported by the breakaway support;

wherein the first biasing device applies a tensile force to the first breakaway support in the supporting position and as the upper frame transitions between the erected and collapsed positions; and one or more doors pivotally connected to the base frame or the upper frame for at least partially concealing the person in the blind when the one or more doors are in a closed position.

2. The blind of claim 1 further comprising a rip cord attached to the first breakaway support for pulling the breakaway support from the supporting position to a non-supporting position.

3. The blind of claim 1 further comprising a stop disposed on the base frame or the upper frame for stopping the one or more doors from pivoting too far in one direction.

4. The blind of claim 1 wherein the first breakaway support includes a double breakaway hinge attached to the breakaway support to allow the breakaway support to no longer support the upper frame in the collapsed position.

5. The blind of claim 1 wherein the cover is camouflaged.

6. The blind of claim 1 wherein the frames fold together.

7. The blind of claim 1 wherein the frame is constructed of tubular material.

8. The blind of claim 1 further comprising a plurality of hinges connecting the base frame to the upper frame, the base frame to the breakaway support and the upper frame to the breakaway support.

9. A portable hunting blind comprising:

a base frame;

an upper frame hingingly connected to the base frame;

a breakaway support hingingly connected between the base frame and the upper frame;

a biasing device connected to the breakaway support for holding the breakaway support in a first position to support the upper frame above the base frame and allowing the upper frame to hinge towards the base frame when the breakaway support is moved to a second position;

a cover attached to the frames for at least partially concealing an inside area of the blind;

wherein the biasing device applies a tensile force to the breakaway support as the breakaway support moves between the first and second positions; and a door attached to one of the frames, the door hinges open and closed allowing entry to and exit from the inside area of the blind.

10. The blind of claim 9 wherein the breakaway support hinges on itself to move from the first position to the second position.

11. The blind of claim 9 having an opening in the cover to allow viewing from inside the blind to outside the blind.

12. The blind of claim 9 wherein the cover is thermal to maintain heat on the inside area of the blind.

13. A portable hunting blind comprising:

a base frame;

an upper frame pivotally connected to the base frame;

a first breakaway support operatively connected between the base frame and the upper frame for supporting the upper frame in an erected position and allowing the upper frame to pivot to a collapsed position when the breakaway support no longer supports the upper frame;

a first biasing device attached to the first breakaway support for holding the breakaway support in a supporting position while supporting the upper frame in the erected position; and a cover attached to the blind to at least partially conceal a person in the blind when the upper frame is supported by the breakaway support;

wherein the first biasing device applies a tensile force to the first breakaway support in the supporting position and as the upper frame transitions between the erected and collapsed positions; and wherein the first biasing device is an elastic cord.

14. The portable hunting blind of claim 13 further comprising a plurality of hinges operatively connecting the upper frame to the base frame and allowing the upper frame to pivot from the erected position to the collapsed position.

15. The portable hunting blind of claim 14 wherein the first breakaway support comprises a breakaway support bar having a first end and an opposite second end with a breakaway hinge disposed there between.

16. A portable hunting blind comprising:

a base frame;

an upper frame pivotally connected to the base frame;

a first breakaway support operatively connected between the base frame and the upper frame for supporting the upper frame in an erected position and allowing the upper frame to pivot to a collapsed position when the breakaway support no longer supports the upper frame;

a first biasing device attached to the first breakaway support for holding the breakaway support in a supporting position while supporting the upper frame in the erected position; and a cover attached to the blind to at least partially conceal a person in the blind when the upper frame is supported by the breakaway support;

wherein the first biasing device applies a tensile force to the first breakaway support in the supporting position and as the upper frame transitions between the erected and collapsed positions;

a second breakaway support operatively connected between the base frame and the upper frame for supporting the upper frame in an erected position and allowing the upper frame to pivot to a collapsed position when the breakaway support no longer supports the upper frame;

a second biasing device attached to the second breakaway support for holding the second breakaway support in a supporting position while supporting the upper frame in the erected position;

wherein the first and second biasing devices apply opposing tensile forces to the first and second breakaway supports in the supporting position and as the upper frame transitions between the erected and collapsed positions; and wherein the first and second biasing devices are elastic cords.

* * * * *